US006739373B1

(12) United States Patent
Liu et al.

(10) Patent No.: US 6,739,373 B1
(45) Date of Patent: May 25, 2004

(54) LIFT CONTROL DEVICE FOR A ROLLER SHADE

(76) Inventors: Tai-Ping Liu, No. 15, Alley 8, Lane 3, Kuo-Chi St., Lung-Ching Hsiang, Taichung Hsien (TW); Patrick James McGrath, 9F, No. 86-2, Jungan St., Junghe City, Taipei Hsien (TW); Wasyl R. Bodnar, 3342 Warwood Rd., Lakewood, CA (US) 90712-3750

( * ) Notice: Subject to any disclaimer, the term of this patent is extended or adjusted under 35 U.S.C. 154(b) by 0 days.

(21) Appl. No.: 10/383,549

(22) Filed: Mar. 10, 2003

(51) Int. Cl.[7] ..... A47G 005/02
(52) U.S. Cl. ..... 160/321
(58) Field of Search ..... 160/321, 320, 160/319, 176.1 R, 177 R, 177 V, 168.1 R, 173 R; 475/178

(56) References Cited

U.S. PATENT DOCUMENTS 2,334,132 A * 11/1943 Sherwood ..... 160/176.1 R
3,304,808 A * 2/1967 Grant ..... 475/173
3,965,773 A * 6/1976 Bert et al. ..... 475/165
4,177,695 A * 12/1979 Grove ..... 475/177
4,372,432 A * 2/1983 Waine et al. ..... 192/223.4
4,657,060 A * 4/1987 Kaucic ..... 160/168.1 V
4,834,163 A * 5/1989 Dickstein ..... 160/176.1 R
5,123,883 A * 6/1992 Fukaya ..... 475/178
5,137,073 A * 8/1992 Huang ..... 160/321
5,484,345 A * 1/1996 Fukaya ..... 475/162
5,803,148 A * 9/1998 Madsen ..... 160/176.1 R
6,148,893 A * 11/2000 Cadorette ..... 160/176.1 P

FOREIGN PATENT DOCUMENTS

FR 2666129 * 8/1990

* cited by examiner

*Primary Examiner*—Blair M. Johnson
(74) *Attorney, Agent, or Firm*—Fei-Fei Chao; Venable LLP

(57) ABSTRACT

A lift control device for a roller shade has a side cover, a roller, a chain retaining wheel, a chain and a follower spool. The side cover has an axle and multiple inner teeth. The roller is rotatably mounted around and is eccentric to the axle. The roller has multiple teeth partially engaging with the inner teeth on the side cover and at least one stub. The chain retaining wheel has an eccentric hole to rotatably receive the roller. The follower spool is attached to the chain retaining wheel and engages with the roller to rotate with the roller. Accordingly, a shade blind connected to the follower spool is actuated in instant when the chain is drawn. The follower spool is kept from rotating even when a large force applied to the follower spool, and the safety of using the roller shade is improved.

9 Claims, 6 Drawing Sheets

LIFT CONTROL DEVICE FOR A ROLLER SHADE

BACKGROUND OF THE INVENTION

1. Field of the Invention

The present invention relates to a lift control device, and more particularly to a lift control device for a roller shade.

2. Description of Related Art

With reference to FIG. 6, a conventional lift control device for a roller shade comprises a support rod (80), a spring (82), a roller cap (86) and a follower spool (89). The support rod (80) is adapted to connect to a frame of the roller shade through a bracket (not shown). The spring (82) is mounted around the support rod (80) and has two coiled portions (83). Each coiled portion (83) has a bent distal end (85), and a connecting lug (84) is formed between the coiled portions (83). The roller cap (86) is rotatably mounted on the support rod (80) and has a retaining opening (87) corresponding to the spring (82). The bent distal ends (85) on the coiled portions (83) abut one side of the retaining opening (87), and the connecting lug (84) between the coiled portions (83) abuts the other side of the retaining opening (87). A chain retaining wheel (not numbered) is mounted on one end of the roller cap (86), and a loop-shaped chain (88) is secured to the chain retaining wheel to rotate the chain retaining wheel when the chain (88) is drawn. The follower spool (89) is attached on the roller cap (86) to rotate with the roller cap (86). The follower spool (89) is adapted to connect to a roller tube (not shown) on which a shade blind is mounted. An elongated rib (not numbered) is formed on the inner wall of the follower spool (89) and is located between the connecting lug (84) and the distal ends (85) of the coiled portions (83). When the chain (88) is drawn, the roller cap (86) will be rotated so as to push either the connecting lug (84) or the distal ends (85) of the coiled portions (83). The elongated rib will be pushed by the connecting lug (84) or the distal ends (85), such that the follower spool (89) will rotate with the roller cap (86). Accordingly, the lifting or lowering of the shade blind can be controlled by means of drawing the chain (88) through the lift control device.

However, the conventional lift control device has the following shortcomings.

1. Because there is a gap defined between the elongated rib and the connecting lug (84) or the distal ends (85) of the coiled portions (83), the follower spool (89) cannot be actuated in the instant when the chain (88) is pulled. The shade blind of the roller shade cannot be lifted or lowered a slight distance by the conventional lift control device.

2. The movement of the follower spool (89) is limited by the friction of the coiled portions of the spring (82) between the support rod (80). When a force applied to the shade blind is larger than the friction provided by the spring (82), the shade blind will be forced to lower. More specifically, a large shade blind having a weight larger than the friction provided by the spring (82) will unintentionally lower due to the weight of the shade blind. Thus the safety of using the conventional lift control device is not enough. The conventional lift control device cannot be used in a roller shade with a large shade blind, and the use of the conventional lift control device is not versatile.

3. The resiliency of the spring (82) will be lost after a long time of use, and the useful life of the conventional lift control device is inconveniently short.

To overcome the shortcomings, the present invention tends to provide a lift control device to mitigate or obviate the aforementioned problems.

SUMMARY OF THE INVENTION

The main objective of the invention is to provide a lift control device for a roller shade that can make a shade blind of the roller shade lift or lower instantly when a chain is drawn.

The secondary objective of the invention is to provide a lift control device for a roller shade to make the use of the lift control versatile and to improve the safety of use the shade blind.

Other objects, advantages and novel features of the invention will become more apparent from the following detailed description when taken in conjunction with the accompanying drawings.

DETAILED DESCRIPTION OF PREFERRED EMBODIMENT

Figure 1:
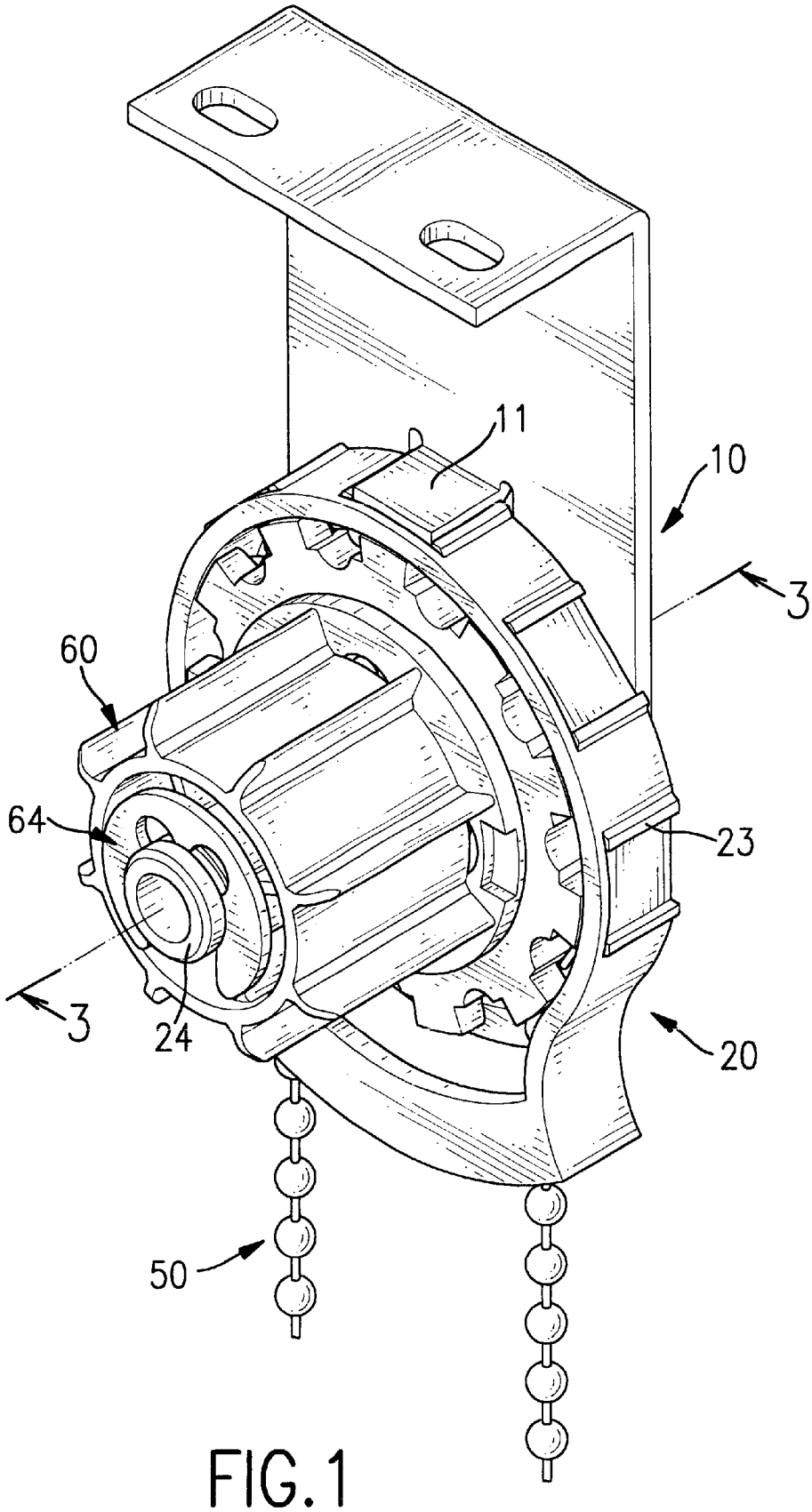
FIG. 1 is a perspective view of a lift control device in accordance with the present invention.
Figure 2:
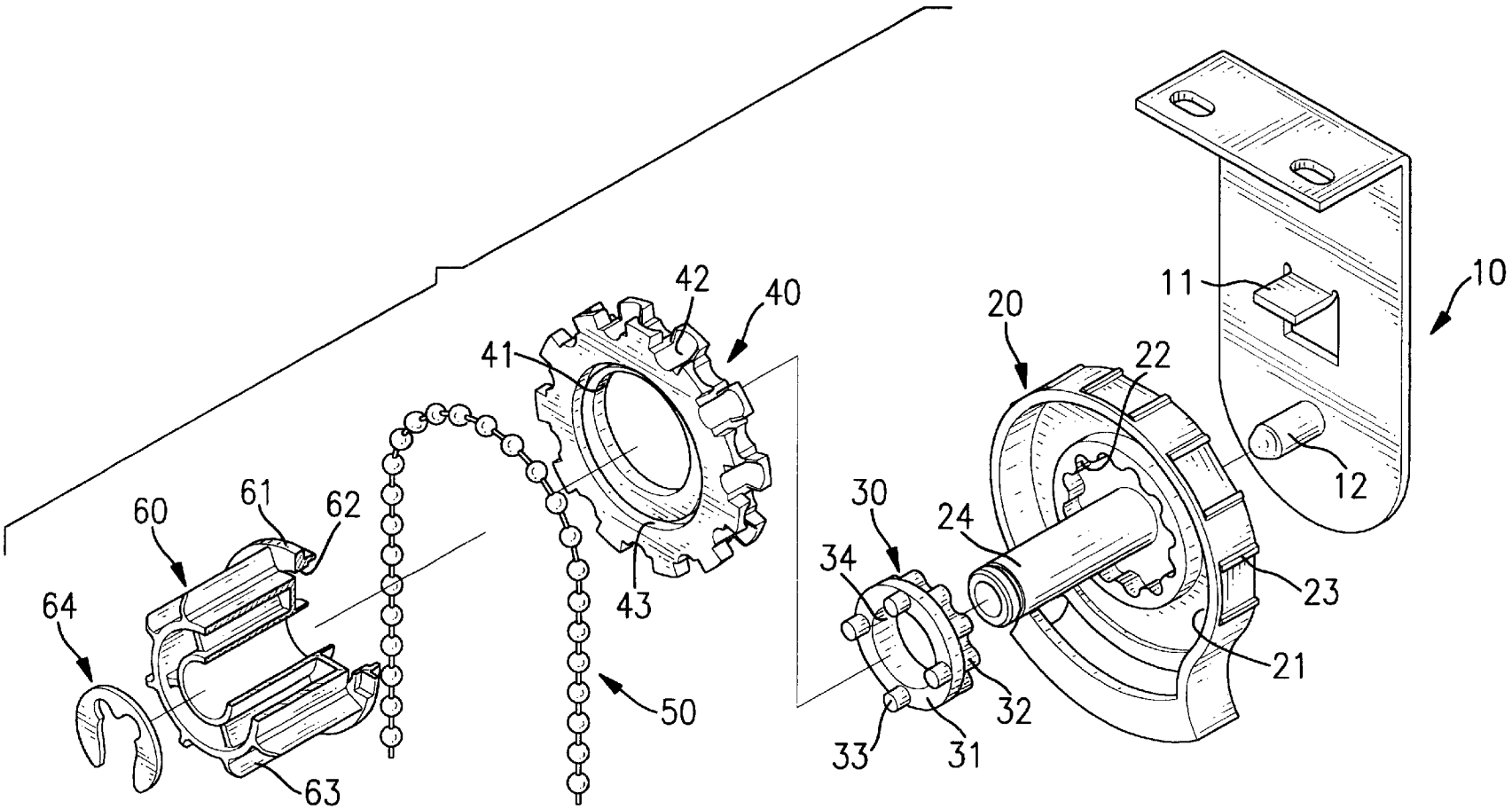
FIG. 2 is an exploded perspective view of the lift control device in FIG. 1.
Figure 3:
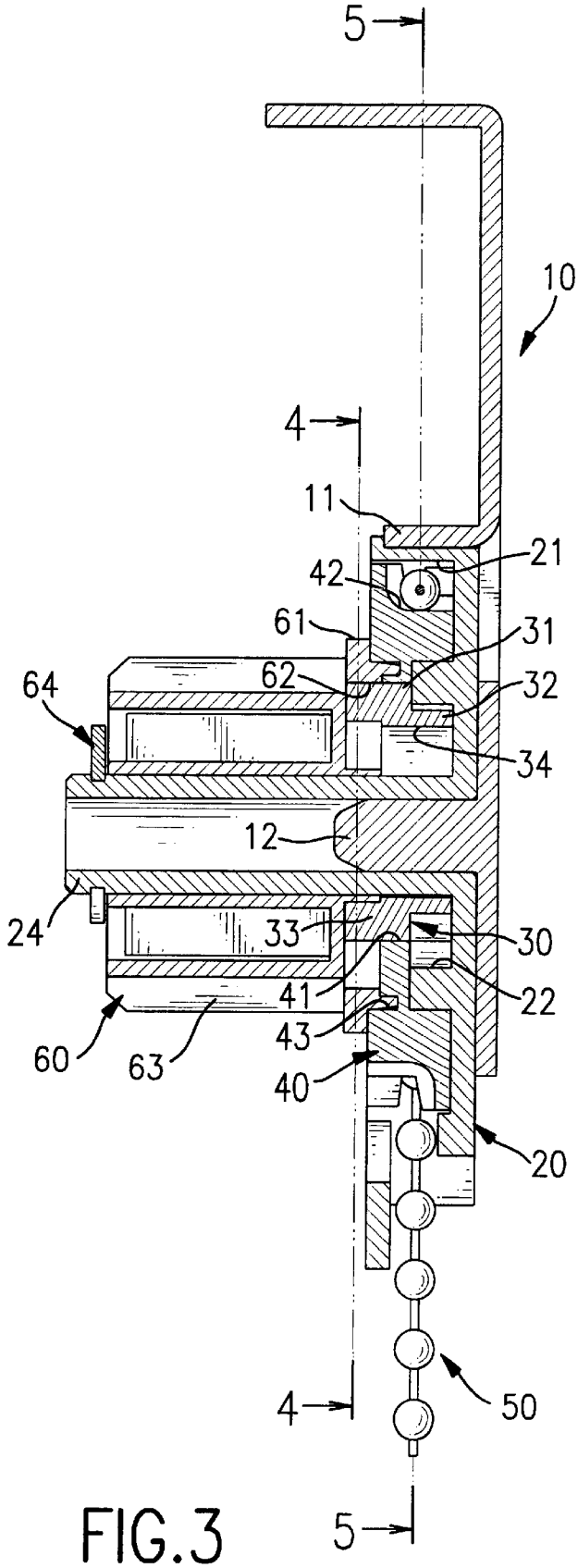
FIG. 3 is a side plan view in partial cross section of the lift control device in FIG. 1.

With reference to FIGS. 1 to 3, a lift control device for a roller shade in accordance with the present invention comprises a side cover (20), a roller (30), a chain retaining wheel (40), a chain (50) and a follower spool (60). The side cover (20) has a chamber (21) with an inner surface defined in one side of the side cover (20). An axle (24) with a center extends outward from the inner surface of the chamber (21). Multiple inner teeth (22) are formed on the inner surface of the chamber (21) and around the axle (24). The side cover (20) is adapted to connect to a frame of the roller shade, and in practice, the side cover (20) is adapted to connect to a frame of the roller shade through a bracket (10). The bracket (10) has an L-shaped body, and a tongue (11) and an insert post (12) laterally extending from the L-shaped body. The side cover (20) has multiple engaging recesses (not numbered) with two sides defined around the side cover (20). A hole (not numbered) is defined in one end of the axle (24) facing the bracket (10). When the side cover (20) is attached to the bracket (10), the insert post (12) is inserted into the hole in the axle (24) and the tongue (11) engages with one of the recesses in the side cover (20). Accordingly, the side cover (20) is securely held on the bracket (10) in place by means of the engagements between the tongue (11) and the corresponding recess and between the insert post (12) and the hole in the axle (24). In addition, two walls (23) are respectively formed on two sides of each recess to hold the tongue (11) on the bracket (10) in place when the tongue (11) is received in the recess. When the tongue (11) engages with another recess in the side cover (20), the side cover (20) will be positioned at different angle relative to the bracket (10).

The roller (30) is rotatably received in the chamber (21) in the side cover (20) and is mounted around the axle (24). The roller (30) has an annular body (31) with a central hole

(34) for the axle (24) extending through the central hole (34). Multiple teeth (32) are formed on one side of the annular body (31) facing the side cover (20), and parts of teeth (32) engage with parts of the inner teeth (22) on the side cover (20). Four stubs (33) extend from the other side of the annular body (31) away from the side cover (20).

Figure 4:
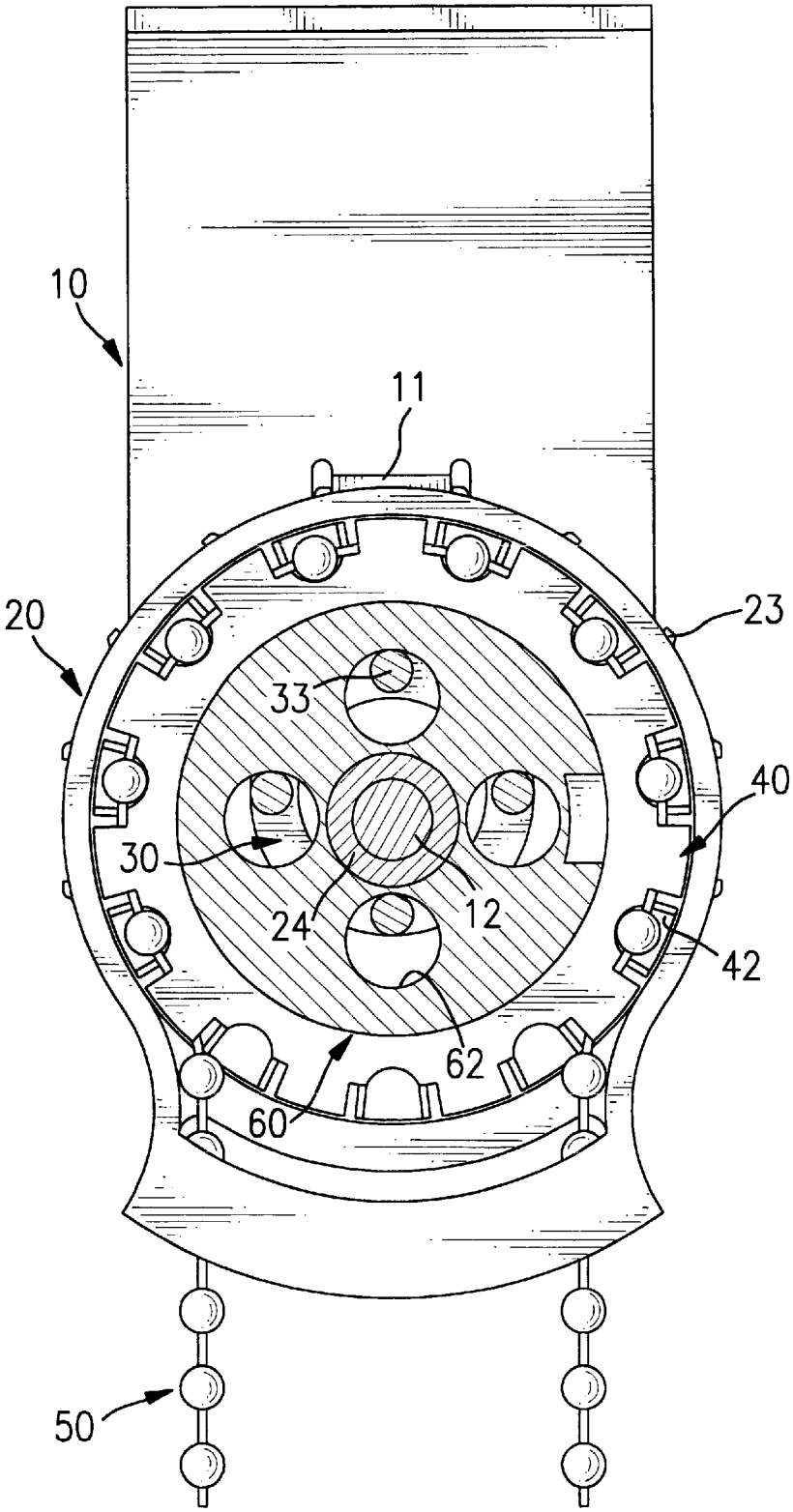
FIG. 4 is a front plan view in partial cross section of the lift control device along line 4—4 in FIG. 3.
Figure 5:
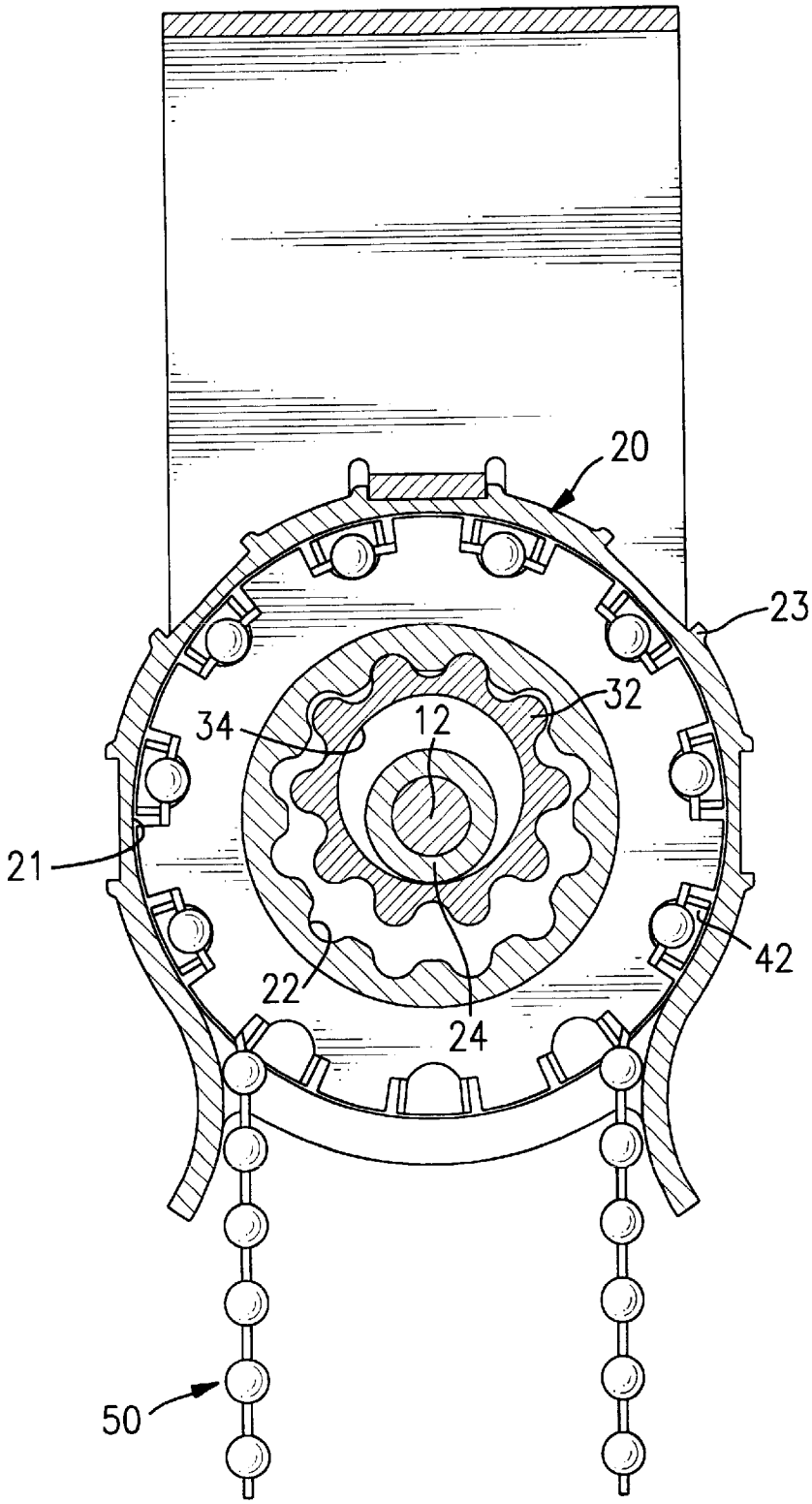
FIG. 5 is another front plan view in partial cross section of the lift control device along line 5—5 in FIG. 3.
Figure 6:
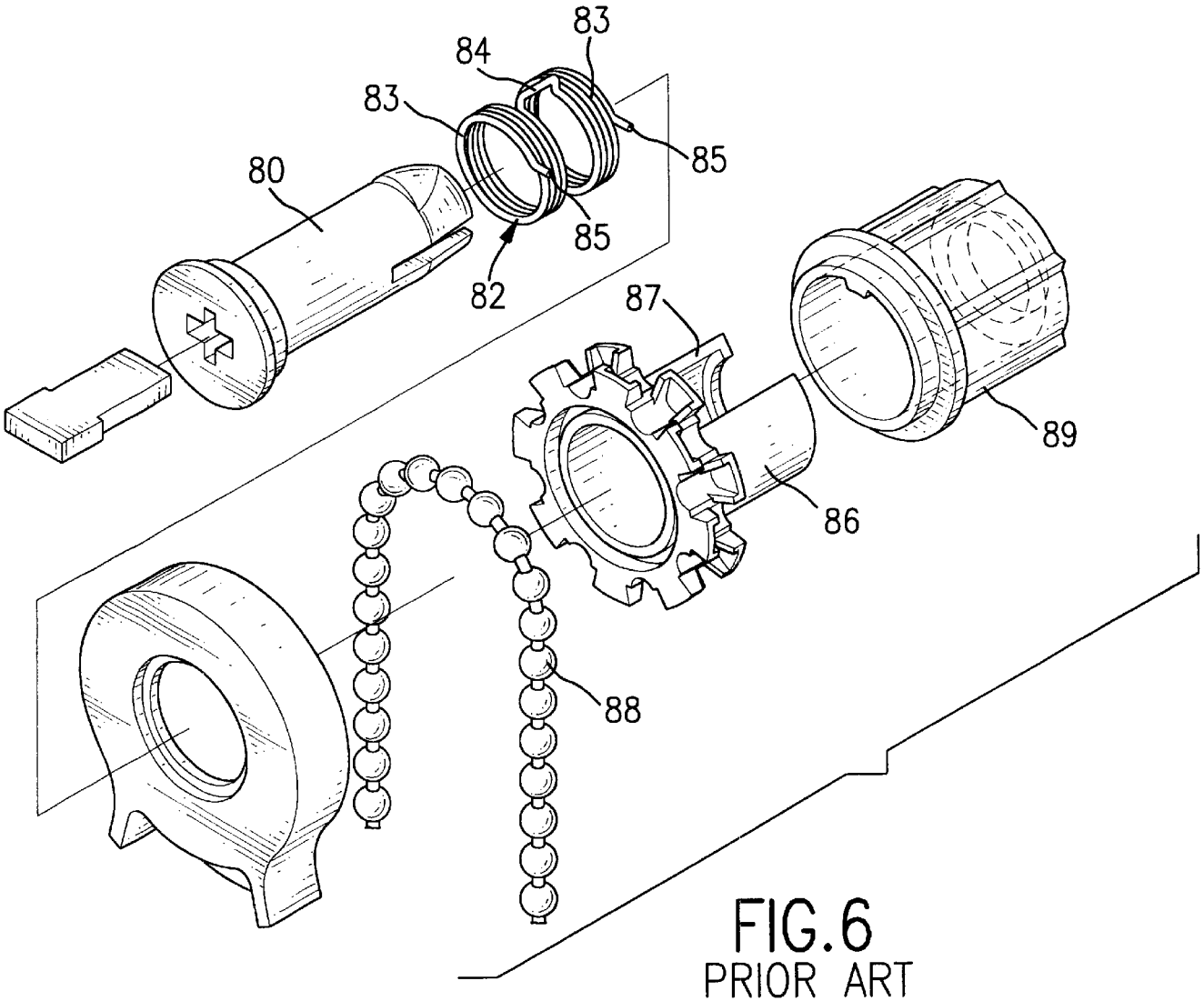
FIG. 6 PRIOR ART
FIG. 6 is an exploded perspective view of a conventional lift control device in accordance with the prior art.

The chain retaining wheel (40) is rotatably received in the chamber (21) in the side cover (20) and is mounted around the roller (30). The chain retaining wheel (40) has an annular body with a center, and the center of the annular body coincides with the center of the axle (24) on the side cover (20). An eccentric hole (41) is defined through the annular body of the chain retaining wheel (40) and is eccentric to the center of the annular body to rotatably receive the roller (30). With further reference to FIGS. 4 and 5, the eccentric hole (41) has an inner diameter equal to a diameter of the annular body (31) of the roller (30), such that the roller (30) is eccentric relative to the center of the axle (24) on the side cover (20). In addition, the central hole (34) in the roller (30) has an inner surface abutting against the axle (24) at a position apart from the teeth (32) engaging with the inner teeth (22) on the side cover (20).

Multiple ball sockets (42) are mounted around the annular body of the chain retaining wheel (40). The chain (50) is loop-shaped and is secured to the chain retaining wheel (40) to rotate the chain retaining wheel (40). The chain (50) has multiple balls, and parts of the balls are received in parts of the ball sockets (42) on the chain retaining wheel. Accordingly, the chain retaining wheel (40) will be rotated when the chain (50) is drawn.

The follower spool (60) is attached to the chain retaining wheel (40), and the axle (24) on the side cover (20) has a free end extending through the follower spool (60). A fastener (64) is attached to the free end of the axle (24) to hold the follower spool (60) in place. A connecting disk (61) with an annular lip (not numbered) is formed on one end of the follower spool (60) facing the chain retaining wheel (40). Bores (62) are defined in the connecting disk (61) to receive each respective stub (33) on the roller (30). Accordingly, the follower spool (60) will rotate with the roller (30) by means of the engagements between the stubs (33) and the corresponding bores (62). An annular channel (43) is defined in one side of the annular body of the chain retaining wheel (40) to receive the annular lip on the follower spool (60). Multiple ribs (63) are formed on the follower spool (60) to engage with a roller tube (not shown) on which a shade blind is attached.

With reference to FIGS. 3 to 5, when the chain (50) is drawn, the chain retaining wheel (40) is rotated relative to the axle (24). Because the roller (30) is received in the eccentric hole (41) in the chain retaining wheel (40) and is eccentric relative to the center of the axle (24), the roller (30) will rotate with the chain retaining wheel (40) and relative to the axle (24). Furthermore, with the engagement between the teeth (32) on the roller (30) and the inner teeth (22) on the side cover (20), the roller (30) will also rotate relative to the eccentric hole (41) in the chain retaining wheel (40) according to the following input/output ratio formula:

$$N1/(N1-N2)$$

Wherein, N1 equals the number of teeth on the roller (30) and N2 equals the number of inner teeth (22) on the side cover (20).

For example, if N1=8 and N2=12, then the input versus output ratio will equal −2/1, with the minus sign signifying that the input versus output directions of rotation of the chain retaining wheel (40) versus the follower spool (60) are reversed. The required input torque versus output torque will also be halved, requiring less input force to raise heavy roll curtains.

If N1=10 and N2=12, then the input versus output ratio will equal −5:1 with an accompanying advantage of five times the output torque force being generated versus input torque to raise heavy roll curtains. This compares to a 1:1 torque input to output ratio of current lift control device designs. Of course, two times or five times the length of chain pull will also be required to achieve these torque advantages but that is easily achieved in a 2:1 embodiment with any current style chain and in the 5:1 embodiment by the use of existing "endless" chains or cords.

Accordingly, the follower spool (60) will rotate with the roller (30) due to the engagements of the stubs (33) and the corresponding bores (62). The secondarily rotating stubs (33) follow an epicycloid path inside the bores (62) which is caused by the eccentricity of roller (30) causing rotation of the stubs around the centerlines of the bores in a circular path whose diameter is equal to twice the amount of eccentricity of eccentric hole (41) while the entire roller (30) and the stubs (33) it carries simultaneously rotates about the centerline of side cover (20). This compound rotation creates the useful secondary epicycloid rotation of the stubs (33) inside the bores (62) which causes follower spool (60) to rotate smoothly.

The utility of creating this complicated epicycloidal rotation of the stubs (33) is so the lift control device can be caused to rotate only when a torque force is applied to the input chain-retaining-wheel (40) side but not rotate when a torque force is applied to the output follower-spool (60) side. The shade blind will be lifted or lowered instantly when the chain (50) is drawn. Consequently, the shade blind will be lifted or lowered a slight distance with the lift control device, and the use and the operation of the lift control device are convenient.

When a torque force, for example the weight of the shade blind, is applied to the follower spool (60) the follower spool (60) will be kept from rotating because the roller (30) is engaged in the inner teeth (22) on the side cover (20). In order to backdrive the lift control device, the roller would have to rotate on its eccentric centerline in eccentric hole (41) but the teeth (32) of the roller (30) are prevented from rotating on this centerline by their engagement in the inner teeth (22). This locking effect only occurs for rotating forces created on the output side of the lift control mechanism. Rotating forces created on the input side of the mechanism are able to create rotation of the mechanism freely in both directions at any time.

Accordingly, the shade blind will be positioned in the lifted or lowered position when the force for drawing the chain is released. This can keep the shade blind from unintentionally lowering when a force is applied to the shade blind or when the shade blind is particularly heavy due to its size. Consequently, the lift control device in accordance with the present invention can be used in a roller shade with a large shade blind. The use of the lift control device is versatile, and the safety of using a roller shade with the lift control device in accordance with the present invention is improved.

Because the present invention is a unique combination of an internal gear with a cycloid feature, it solves practical design problems that an internal gear device or cycloid drive device alone would not overcome. For example, an internal gear device would be rotatable from both the input and output sides and a cycloid device alone would not rotate efficiently when reduced to the low 2:1 input versus output ratios often preferred in lift control devices.

In addition, because no spring is arranged in the lift control device in accordance with the present invention, the useful life of the lift control device will be prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lift control device for a roller shade comprising:

a side cover with two sides and having a chamber with an inner surface defined in one side of the side cover;

an axle with a center extending outward from the inner surface of the chamber; and multiple inner teeth formed on the inner surface and around the axle;

a roller rotatably received in the chamber in the side cover and mounted around the axle, and the roller having an annular body with a diameter and a central hole mounted around the axle and having a first side facing the side cover and a second side;

multiple teeth formed on the first side of the annular body and parts of the teeth engaging with parts of the inner teeth on the side cover; and at least one stub extending from the second side of the annular body;

a chain retaining wheel rotatably received in the chamber in the side cover and mounted around the roller, and the chain retaining wheel having an annular body with a center; and an eccentric hole defined through the annular body and eccentric to the center of the annular body of the chain retaining wheel to rotatably receive the roller;

a chain secured to the chain retaining wheel to rotate the chain retaining wheel; and a follower spool attached to the chain retaining wheel and engaging with the at least one stub on the roller to rotate with the roller, wherein the center of the annular body coincides with the center of the axle on the side cover;

the eccentric hole has an inner diameter equal to the diameter of the annular body of the roller so that the roller is eccentric relative to the center of the axle on the side cover; and the central hole in the roller has an inner surface abutting against the axle at a position apart from the parts of the teeth on the roller engaging with the corresponding parts of the inner teeth on the side cover.

2. The lift control device as claimed in claim 1 further comprising a bracket for the side cover being attached to the bracket.

3. The lift control device as claimed in claim 2, wherein the bracket has an L-shaped body and a tongue laterally extending from the L-shaped body;

the side cover has multiple engaging recesses with two sides defined around the side cover; and one of the engaging recesses engages with the tongue on the bracket.

4. The lift control device as claimed in claim 3, wherein the axle on the side cover has a hole defined in one end of the axle facing the bracket; and the bracket has an insert post laterally extending from the L-shaped body and inserted into the hole in the axle.

5. The lift control device as claimed in claim 4, wherein each recess in the side cover has two walls respectively formed on two sides of the recess to hold the tongue on the bracket in place when the tongue engages with the recess.

6. The lift control device as claimed in claim 1, wherein the chain has multiple balls; and the chain retaining wheel has multiple ball sockets mounted around the annular body of the chain retaining wheel to selectively receive the balls on the chain.

7. The lift control device as claimed in claim 6, wherein the follower spool has a connecting disk with an annular lip formed on one end of the follower spool facing the chain retaining wheel; and the chain retaining wheel has an annular channel defined in one side of the annular body to receive the annular lip on the follower spool.

8. The lift control device as claimed in claim 7, wherein the axle has a free end extending through the follower spool; and a fastener attached to the free end of the axle to hold the follower spool in place.

9. The lift control device as claimed in claim 7, wherein the connecting disk has a bore for receiving each respective at least one stub on the roller.

* * * * *